US008328309B2

(12) United States Patent
Izumi et al.

(10) Patent No.: US 8,328,309 B2
(45) Date of Patent: Dec. 11, 2012

(54) INK JET HEAD AND METHOD OF DRIVING THE SAME

(75) Inventors: Takao Izumi, Kanagawa-ken (JP); Takashi Kado, Shizuoka-ken (JP); Yoshiaki Kaneko, Shizuoka-ken (JP); Masashi Hiroki, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 31 days.

(21) Appl. No.: 13/118,825

(22) Filed: May 31, 2011

(65) Prior Publication Data

US 2011/0292108 A1 Dec. 1, 2011

Related U.S. Application Data

(60) Provisional application No. 61/350,173, filed on Jun. 1, 2010.

(51) Int. Cl.
*B41J 29/38* (2006.01)

(52) U.S. Cl. ..... 347/10; 347/68; 347/5

(58) Field of Classification Search ..... 347/5, 9, 347/10, 14, 19, 20, 23, 40, 42
See application file for complete search history.

(56) References Cited

U.S. PATENT DOCUMENTS 6,685,293 B2 * 2/2004 Junhua ..... 347/14
6,840,595 B2 1/2005 Kusunoki
7,249,816 B2 * 7/2007 Kusunoki et al. ..... 347/10

* cited by examiner

*Primary Examiner* — Juanita D Jackson
(74) *Attorney, Agent, or Firm* — Turocy & Watson, LLP

(57) ABSTRACT

According to one embodiment, an ink jet head includes pressure chambers filled with liquid, nozzles discharging the liquid that is in the pressure chambers, actuators changing the capacity of the pressure chambers, and a processor. The processor repeatedly outputs a waveform voltage including an expansion pulse, a ground potential, a contraction pulse, and a ground potential in this order, as a driving voltage with respect to the actuators.

14 Claims, 4 Drawing Sheets

INK JET HEAD AND METHOD OF DRIVING THE SAME

CROSS-REFERENCE TO RELATED APPLICATIONS

This application is based upon and claims the benefit of priority from U.S. Provisional Application No. 61/350,173, filed on Jun. 1, 2010, the entire contents of which are incorporated herein by reference.

FIELD

Embodiments described herein relate generally to an ink jet head used for an ink jet printer or the like and a method of driving the same.

BACKGROUND

Conventionally, a liquid discharge device, a so-called ink jet head, used for an ink jet printer or the like includes pressure chambers filled with ink, nozzles respectively communicating with the pressure chambers, and actuators arranged in the pressure chamber. The actuators expand or contract the capacity of the pressure chambers. Due to the expansion and contraction, ink droplets are discharged from the nozzles.

A plurality of ink droplets are continuously discharged from the nozzles, and one pixel is formed by the plurality of ink droplets, whereby an image of high-gradation can be printed. If the frequency of the driving voltage with respect to the actuators is increased, the discharge intervals of the plurality of ink droplets discharged from the nozzle are shortened, so it is possible to speed up printing.

Here, whenever one droplet of ink is discharged, vibration remains in the ink that is in the pressure chamber. If the next droplet of ink is discharged while the vibration is not yet dampened, it is not easy to appropriately discharge the ink droplet.

DETAILED DESCRIPTION

In general, according to one embodiment, an ink jet head includes a pressure chamber filled with liquid, a nozzle discharging the liquid that is in the pressure chamber, an actuator changing the capacity of the pressure chamber, and a processor which repeatedly outputs a waveform voltage including, in order, an expansion pulse for expanding the capacity of the pressure chamber, a ground potential for returning the capacity of the pressure chamber back to a normal state from the expansion caused by the expansion pulse, a contraction pulse for contracting the capacity of the pressure chamber, and a ground potential for returning the capacity of the pressure chamber back to the normal state from contraction caused by the contraction pulse, as a driving voltage with respect to the actuator, sets the time period of the expansion pulse to be half of the natural vibration period of the liquid, sets the time period from the midpoint of the expansion pulse to the midpoint of the contraction pulse to be the natural vibration period, and sets the time period from the midpoint of the contraction pulse to the midpoint of the expansion pulse to be the natural vibration period.

Figure 1:
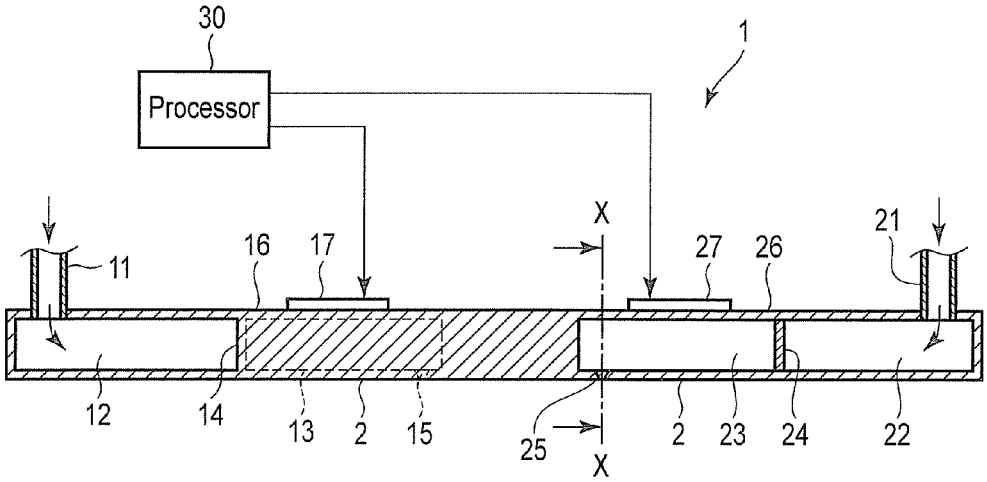
FIG. 1 is a cross-sectional view illustrating the configuration of one embodiment.

Hereinafter, one embodiment will be described with reference to drawings. FIG. 1 illustrates the configuration of an ink jet head.

An ink jet head 1 includes an ink inlet 11 connected to an ink supply source, a storage chamber 12 storing the ink flowing into the ink inlet 11, a plurality of pressure chambers 13 filled with the ink that is in the storage chamber 12, a partition wall 14 separating the pressure chambers 13 from the storage chamber 12, a plurality of first nozzles 15 for discharging ink communicating with each of the pressure chambers 13 respectively, a plurality of vibration plates 16 forming one surface of the wall of each of the pressure chambers 13, and a plurality of piezoelectric devices 17 respectively arranged on the vibration plates 16. The ink jet head 1 also includes an ink inlet 21 connected to the ink supply source, a storage chamber 22 storing the ink flowing into the ink inlet 21, a plurality of pressure chambers 23 filled with the ink that is in the storage chamber 22, a partition wall 24 separating the pressure chambers 23 from the storage chamber 22, a plurality of second nozzles 25 for discharging ink communicating with each of the pressure chambers 23 respectively, a plurality of vibration plates 26 forming one surface of the wall of each of the pressure chambers 23, a plurality of piezoelectric devices 27 respectively arranged on the vibration plates 26, and a processor 30.

Each of the vibration plates 16 and the piezoelectric devices 17 configures a plurality of actuators changing the capacity of each of the pressure chambers 13. When the capacity of the pressure chambers 13 expands, the ink in the storage chamber 12 is introduced into the pressure chambers 13. When the capacity of the pressure chambers 13 contracts, the ink in the pressure chambers 13 is discharged from the corresponding first nozzles 15 as ink droplets.

Each of the vibration plates 26 and the piezoelectric devices 27 configures a plurality of actuators changing the capacity of each of the pressure chambers 23. When the capacity of the pressure chambers 23 expands, the ink in the storage chamber 22 is introduced into the pressure chambers 23. When the capacity of the pressure chambers 23 contracts, the ink in the pressure chambers 23 is discharged from the corresponding second nozzles 25 as ink droplets.

Figure 2:
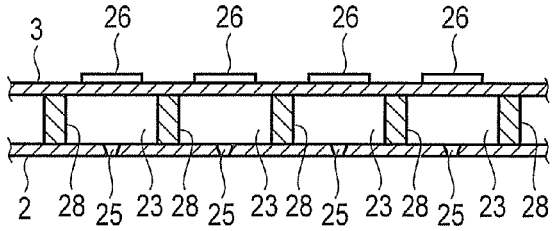
FIG. 2 is a view in which a cross-section taken along the X-X line in FIG. 1 is viewed in the direction of the arrow.
Figure 3:
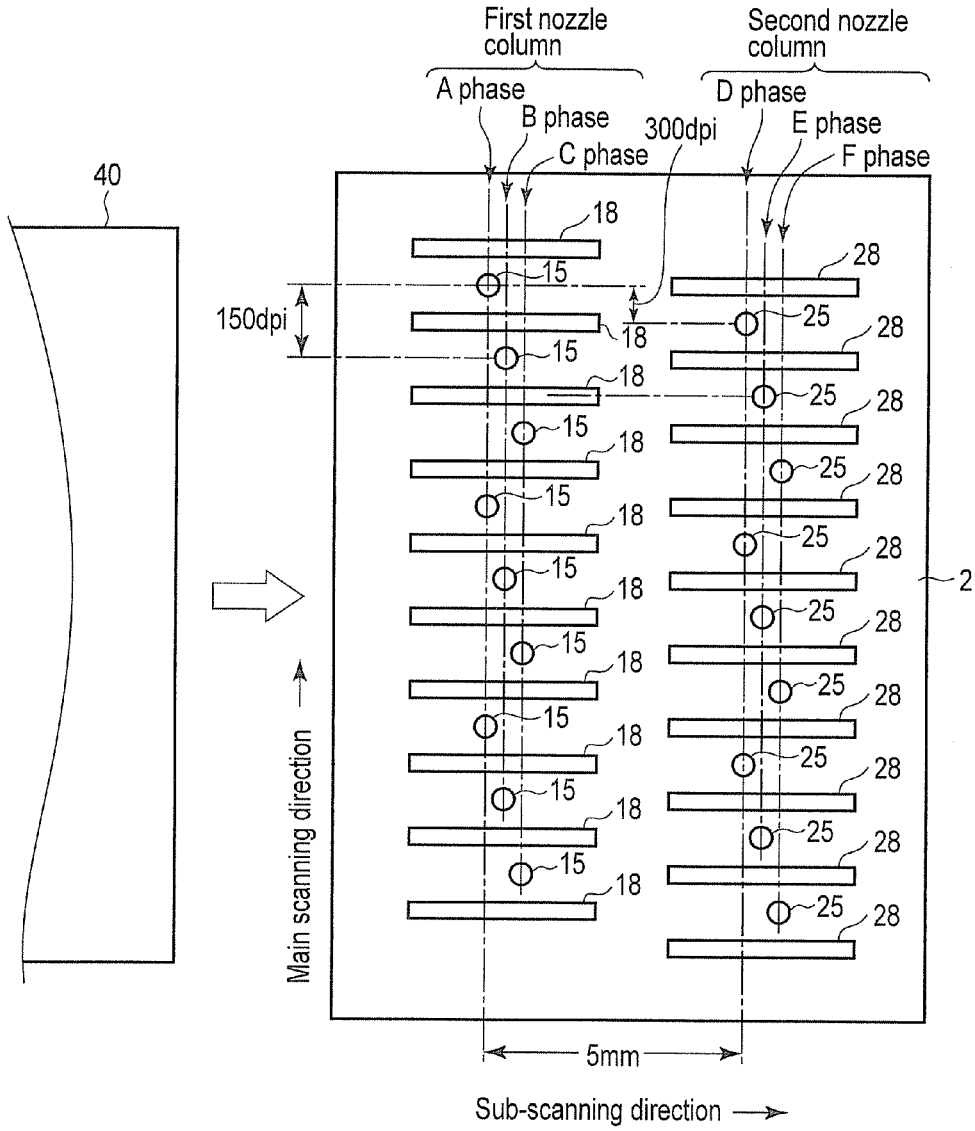
FIG. 3 is a view illustrating a bottom plate forming each pressure chamber and partition walls between each pressure chamber.

FIG. 2 is a view in which a cross-section taken along a line X-X in FIG. 1 is viewed in the direction of the arrow. That is, each of the pressure chambers 23 neighbors each other with a partition wall 28 therebetween. As shown in FIG. 3, each of the pressure chambers 13 also neighbors each other with a partition wall 18 therebetween.

As shown in FIG. 3, a medium receiving the ink discharged from each of the first nozzles 15 and the second nozzles 25, for example, a paper sheet 40, is carried in the direction indicated by a thick arrow. Each of the pressure chambers 13 lines up along the direction orthogonal to the carriage direction of the paper sheet 40. Each of the pressure chambers 23 also lines up along the direction orthogonal to the carriage direction of the paper sheet 40. The arrangement positions of each of the first nozzles 15 and each of the second nozzles 25 alternate with each other in the direction orthogonal to the carriage direction of the paper sheet 40. A gap between each of the first nozzles 15 is about 169.4 μm, which corresponds to a resolution of 150 dpi. A gap between each of the first nozzles 15 and each of the second nozzles 25 is about 84.7 μm, which corresponds to a resolution of 300 dpi.

Each of the first nozzles 15 is arranged along the direction orthogonal to the carriage direction of the paper sheet 40 so as to form a first nozzle column. The first nozzle column includes an A phase nozzle column formed of a nozzle that is in a first chamber and the plurality of first nozzles 15 at every third chamber from the first chamber, a B phase nozzle column arranged at a position deviating from the A phase nozzle column in the carriage direction of the paper sheet 40 by a certain distance and formed of a nozzle that is in a second chamber and the plurality of first nozzles 15 at every third chamber from the second chamber, and a C phase nozzle column arranged at a position deviating from the B phase nozzle column in the carriage direction of the paper sheet 40 by the certain distance and formed of a nozzle that is in a third chamber and the plurality of first nozzles 15 at every third chamber from the third chamber.

The respective second nozzles 25 are arranged at a position deviating from the first nozzle column in the carriage direction of the paper sheet 40 by a predetermined distance, for example, 5 mm, along the direction orthogonal to the carriage direction so as to form a second nozzle column. The second nozzle column includes a D phase nozzle column formed of a nozzle that is in a first chamber and the plurality of second nozzles 25 at every third chamber from the first chamber, an E phase nozzle column arranged at a position deviating from the D phase nozzle column in the carriage direction of the paper sheet 40 by the certain distance and formed of a nozzle that is in a second chamber and the plurality of second nozzles 25 at every third chamber from the second chamber, and an F phase nozzle column arranged at a position deviating from the E phase nozzle column in the carriage direction of the paper sheet 40 by the certain distance and formed of a nozzle that is in a third chamber and the plurality of second nozzles 25 at every third chamber from the third chamber.

Figure 4:
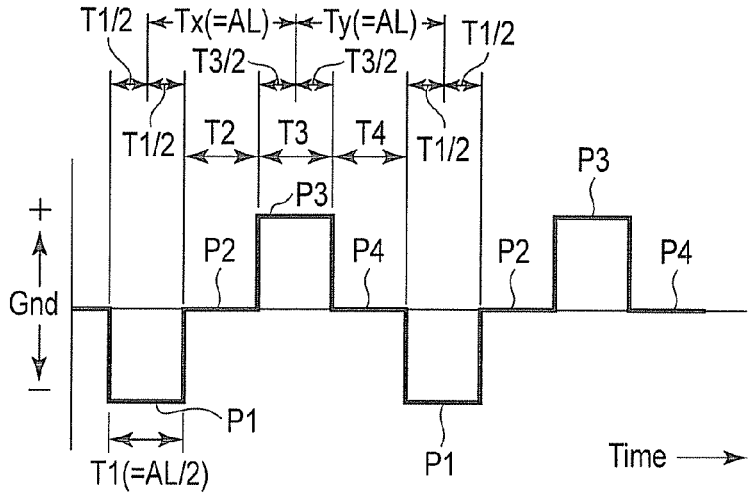
FIG. 4 is a view illustrating the driving voltage waveform.

As shown in FIG. 4, the processor 30 repeatedly outputs a waveform voltage including, in order, an expansion pulse P1 for respectively expanding the capacity of each of the pressure chambers 13 and 23, a ground potential (pulse pause) P2 for returning the capacity of each of the pressure chambers 13 and 23 back to a normal state from the expansion caused by the expansion pulse P1, a contraction pulse P3 for respectively contracting the capacity of each of the pressure chambers 13 and 23, and a ground potential (pulse pause) P4 for returning the capacity of each of the pressure chambers 13 and 23 to the normal state from the contraction caused by the contraction pulse P3, as the driving voltage with respect to each of the actuators. For example, when the driving voltage is repeatedly output three times, three ink droplets are continuously discharged from each of the first nozzles 15 and each of the second nozzles 25. By the continuous discharge of the three ink droplets, one pixel is formed. As a result, it is possible to form an image of four-level gradation.

The time period of the expansion pulse P1 is T1 (μs). The time period of the ground potential P2 is T2 (μs). The time period of the contraction pulse P3 is T3 (μs). The time period of the ground potential P4 is T4 (μs). The potential of the expansion pulse P1 is negative. The potential of the contraction pulse P3 is positive contrary to the potential of the expansion pulse P1. The potential of the expansion pulse P1 may also be positive, and the potential of the contraction pulse P3 may also be negative.

During the time period of the expansion pulse P1, the capacity of each of the pressure chambers 13 and 23 expands. Due to this expansion, the ink in the storage chambers 12 and 22 is introduced into each of the pressure chambers 13 and 23. During the time period of the ground potential P2, the capacity of each of the pressure chambers 13 and 23 returns to a normal state from the expansion caused by the expansion pulse P1. Due to this returning, the ink in each of the pressure chambers 13 and 23 is discharged from each of the nozzles 15 and 25. During the time period of the contraction pulse P3, the capacity of each of the pressure chambers 13 and 23 contracts. During the time period of the ground potential P4, the capacity of each of the pressure chambers 13 and 23 returns to the normal state from the contraction caused by the contraction pulse P3. Due to the contraction and returning, the vibration of the ink in each of the pressure chambers 13 and 23 is suppressed. The suppression of the vibration of the ink is called damping.

The processor 30 sets the time period T1 of the expansion pulse P1 to be half (=AL/2) of a natural vibration period AL of the ink that is in each of the pressure chambers 13 and 23, sets the time period from the midpoint of the expansion pulse P1 to the midpoint of the contraction pulse P3 as the natural vibration period AL, and sets the time period from the midpoint of the contraction pulse P3 to the midpoint of the expansion pulse P1 as the natural vibration period AL.

Figure 5:
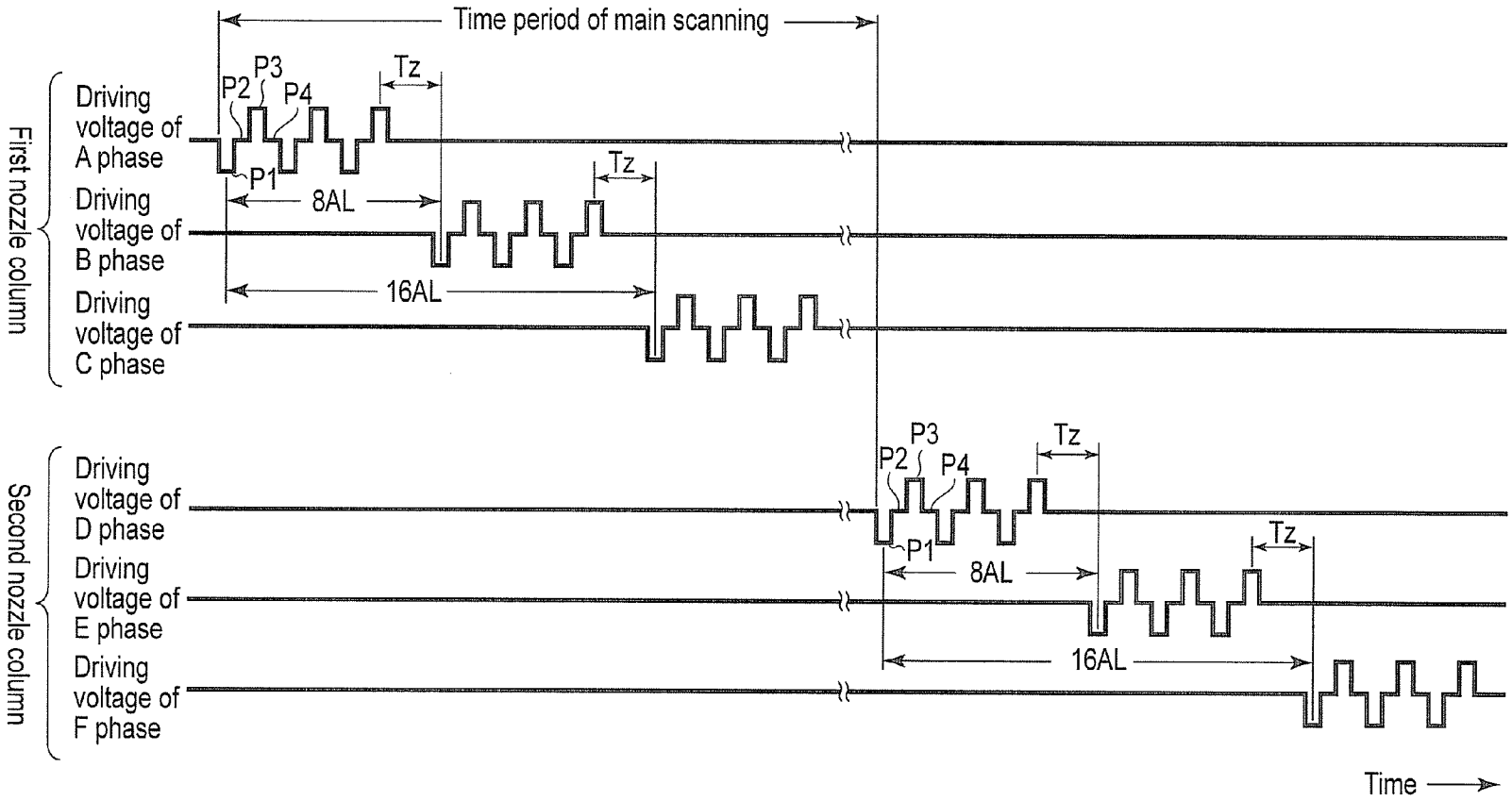
FIG. 5 is a view illustrating the timing when the driving voltage is supplied to each actuator.

Furthermore, as shown in FIG. 5, the processor 30 supplies the driving voltage output repeatedly to each actuator corresponding to each of the first nozzles 15 in the first nozzle column in order (for example, in order of the A phase, the B phase, and the C phase). Subsequently, after a time period Tz (for example, 3 AL) which is an integral multiple of the natural vibration period AL passes, the processor 30 supplies the driving voltage output repeatedly to each actuator corresponding to each of the second nozzles 25 in the second nozzle column in order (for example, in order of the D phase, the E phase, and the F phase). In this manner, each actuator corresponding to each of the first nozzles 15 in the first nozzle column is driven, whereby main scanning for forming a line of image is performed. Each actuator corresponding to each of the second nozzles 25 in the second nozzle column is driven, whereby main scanning for forming a line of an image is performed. The transition from the main scanning performed by each of the first nozzles 15 in the first nozzle column to the main scanning performed by each of the second nozzles 25 in the second nozzle column is called sub-scanning.

Since positions of the A, B, and, C phase nozzle columns deviate from one another along the carriage direction of the paper sheet 40, the position of the ink droplets landing on the paper sheet 40 from the A, B, and, C phase nozzle columns of each of the first nozzles 15 becomes the same in the carriage direction of the paper sheet 40. Since positions of the D, E, and F phase nozzle columns deviate from one another along the carriage direction of the paper sheet 40, the positions of the ink droplets landing on the paper sheet 40 from the D, E, and F phase nozzle columns of each of the second nozzles 25 become the same in the carriage direction of the paper sheet 40.

The time period of the main scanning performed by each of the first nozzles 15 corresponds to a distance in which the paper sheet 40 advances 84.7 μm, which corresponds to a resolution of 300 dpi. Similarly, the time period of the main scanning performed by each of the second nozzles 25 also corresponds to a distance in which the paper sheet 40 advances 84.7 μm. The distance between the first and second nozzle columns is 5 mm as described above. The position of the ink droplets landing on the paper sheet 40 due to the main scanning performed by each of the first nozzles 15 becomes the same as the position of the ink droplets landing on the paper sheet 40 due to the main scanning performed by each of the second nozzles 25 of the second nozzle column, in the carriage direction of the paper sheet 40.

Figure 6:
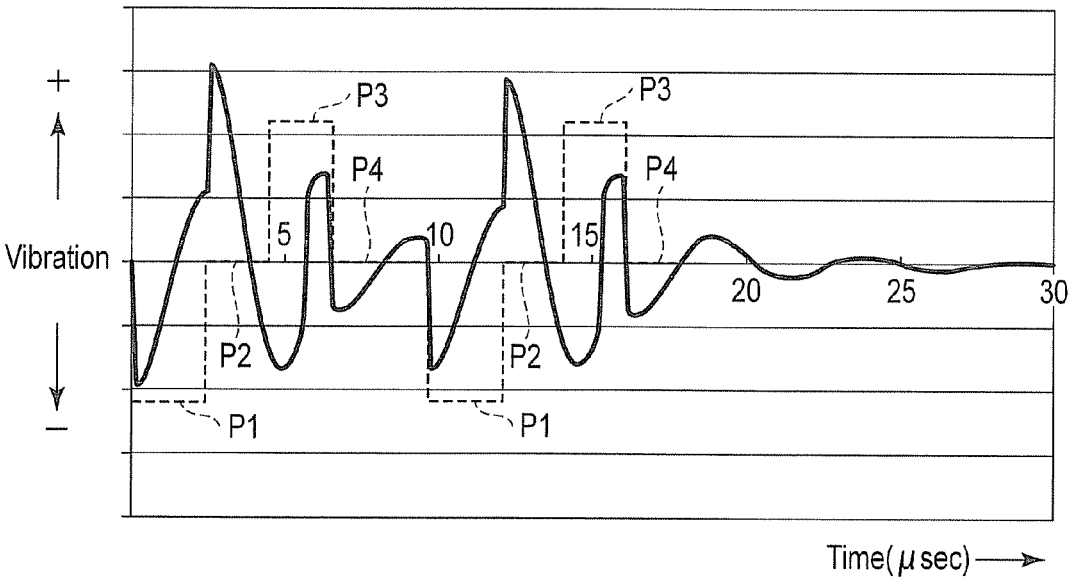
FIG. 6 is a view illustrating the vibration generated in ink.

FIG. 6 illustrates the vibration of the ink in a case where the driving waveform voltage including the expansion pulse P1, the ground potential P2, the contraction pulse P3, and the ground potential P4 in this order is repeatedly supplied to the actuators. That is, while the ink vibrates in one direction at the timing of the expansion pulse P1, vibrates in another direction at the timing of the next ground potential P2, and further vibrates in one direction and another direction at the timing of the next contraction pulse P3 and the ground potential P4, the vibration is reduced before the next expansion pulse P1.

Consequently, it is possible to reliably reduce the vibration generated in the ink that is in the pressure chambers 13 and 23 due to the discharge of one ink droplet before the discharge of the next one ink droplet. As a result, the discharge of one ink droplet does not negatively affect the discharge of the next one ink droplet, and the discharge of one ink droplet from one pressure chamber does not negatively affect the discharge of the ink droplet from another pressure chamber. Even if the frequency of the driving voltage with respect to the actuators is increased to speed up printing, it is possible to stably discharge the ink all the time.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head comprising:

a pressure chamber filled with liquid;

a nozzle discharging the liquid that is in the pressure chamber;

an actuator changing the capacity of the pressure chamber; and a processor which repeatedly outputs a waveform voltage including, in order, an expansion pulse for expanding the capacity of the pressure chamber, a ground potential for returning the capacity of the pressure chamber back to a normal state from the expansion caused by the expansion pulse, a contraction pulse for contracting the capacity of the pressure chamber, and a ground potential for returning the capacity of the pressure chamber back to the normal state from contraction caused by the contraction pulse, as a driving voltage with respect to the actuator, sets the time period of the expansion pulse to be half of the natural vibration period of the liquid, sets the time period from the midpoint of the expansion pulse to the midpoint of the contraction pulse to be the natural vibration period, and sets the time period from the midpoint of the contraction pulse to the midpoint of the expansion pulse to be the natural vibration period.

2. The apparatus of claim 1, wherein the pressure chamber is a plurality of pressure chambers neighboring each other;

the nozzle is a plurality of nozzles respectively discharging the liquid that is in each of the pressure chambers; and the actuator is a plurality of actuators respectively changing the capacity of the pressure chambers.

3. The apparatus of claim 2, wherein each of the pressure chambers lines up along the direction orthogonal to the carriage direction of a medium receiving the liquid discharged from the nozzles; and each of the nozzles includes a plurality of first nozzles forming a first nozzle column arranged along the direction orthogonal to the carriage direction of the medium and a plurality of second nozzles forming a second nozzle column arranged at a position deviating from the first nozzle column in the carriage direction of the medium by a certain distance along the direction orthogonal to the carriage direction.

4. The apparatus of claim 3, wherein the processor supplies the driving voltage output repeatedly to each of the actuators corresponding to each of the first nozzles in order, and after a time period which is an integral multiple of the natural vibration period passes, the processor supplies the driving voltage output repeatedly to each of the actuators corresponding to each of the second nozzles.

5. The apparatus of claim 3, wherein the arrangement positions of each of the first nozzles and each of the second nozzles alternate with each other in the direction orthogonal to the carriage direction of the medium;

the first nozzle column includes an A phase nozzle column formed of a nozzle that is in a first chamber and the plurality of first nozzles at every third chamber from the first chamber, a B phase nozzle column arranged at a position deviating from the A phase nozzle column in the carriage direction of the medium by a certain distance and formed of a nozzle that is in a second chamber and the plurality of first nozzles at every third chamber from the second chamber, and a C phase nozzle column arranged at a position deviating from the B phase nozzle column in the carriage direction of the medium by the certain distance and formed of a nozzle that is in a third chamber and the plurality of first nozzles at every third chamber from the third chamber; and the second nozzle column includes a D phase nozzle column formed of a nozzle that is in a first chamber and the plurality of second nozzles at every third chamber from the first chamber, an E phase nozzle column arranged at a position deviating from the D phase nozzle column in the carriage direction of the medium by the certain distance and formed of a nozzle that is in a second chamber and the plurality of second nozzles at every third chamber from the second chamber, and an F phase nozzle column arranged at a position deviating from the E phase nozzle column in the carriage direction of the medium by the certain distance and formed of a nozzle that is in a third chamber and the plurality of second nozzles at every third chamber from the third chamber.

6. The apparatus of claim 3, wherein the processor supplies the driving voltage output repeatedly to each of the actuators corresponding to each of the first nozzles in order, and then to each of the actuators corresponding to each of the second nozzles in order.

7. The apparatus of claim 1, wherein the polarity of the potential of the expansion pulse is opposite to the polarity of the potential of the contraction pulse.

8. A method of driving an ink jet head including a pressure chamber filled with liquid, a nozzle discharging the liquid that is in the pressure chamber, and an actuator changing the capacity of the pressure chamber, the method comprising:

repeatedly outputting a waveform voltage including, in order, an expansion pulse for expanding the capacity of the pressure chamber, a ground potential for returning the capacity of the pressure chamber back to a normal state from the expansion caused by the expansion pulse, a contraction pulse for contracting the capacity of the pressure chamber, and a ground potential for returning the capacity of the pressure chamber back to the normal state from contraction caused by the contraction pulse, as a driving voltage with respect to the actuator; and setting the time period of the expansion pulse to be half of the natural vibration period of the liquid, setting the time period from the midpoint of the expansion pulse to the midpoint of the contraction pulse to be the natural vibration period, and setting the time period from the midpoint of the contraction pulse to the midpoint of the expansion pulse to be the natural vibration period.

9. The method of claim 8, wherein the pressure chamber is a plurality of pressure chambers neighboring each other;

the nozzle is a plurality of nozzles respectively discharging the liquid that is in each of the pressure chambers; and the actuator is a plurality of actuators respectively changing the capacity of the pressure chambers.

10. The method of claim 9, wherein each of the pressure chambers lines up along the direction orthogonal to the carriage direction of a medium receiving the liquid discharged from the nozzles; and each of the nozzles includes a plurality of first nozzles forming a first nozzle column arranged along the direction orthogonal to the carriage direction of the medium and a plurality of second nozzles forming a second nozzle column arranged at a position deviating from the first nozzle column in the carriage direction of the medium by a certain distance along the direction orthogonal to the carriage direction.

11. The method of claim 10, further comprising:

supplying the driving voltage output repeatedly to each of the actuators corresponding to each of the first nozzles in order, and then to each of the actuators corresponding to each of the second nozzles in order.

12. The method of claim 10, further comprising:

supplying the driving voltage output repeatedly to each of the actuators corresponding to each of the first nozzles in order, and after a time period which is an integral multiple of the natural vibration period passes, supplying the driving voltage output repeatedly to each of the actuators corresponding to each of the second nozzles.

13. The method of claim 10, wherein the arrangement positions of each of the first nozzles and each of the second nozzles alternate with each other in the direction orthogonal to the carriage direction of the medium;

the first nozzle column includes an A phase nozzle column formed of a nozzle that is in a first chamber and the plurality of first nozzles at every third chamber from the first chamber, a B phase nozzle column arranged at a position deviating from the A phase nozzle column in the carriage direction of the medium by a certain distance and formed of a nozzle that is in a second chamber and the plurality of first nozzles at every third chamber from the second chamber, and a C phase nozzle column arranged at a position deviating from the B phase nozzle column in the carriage direction of the medium by the certain distance and formed of a nozzle that is in a third chamber and the plurality of first nozzles at every third chamber from the third chamber; and the second nozzle column includes a D phase nozzle column formed of a nozzle that is in a first chamber and the plurality of second nozzles at every third chamber from the first chamber, an E phase nozzle column arranged at a position deviating from the D phase nozzle column in the carriage direction of the medium by the certain distance and formed of a nozzle that is in a second chamber and the plurality of second nozzles at every third chamber from the second chamber, and an F phase nozzle column arranged at a position deviating from the E phase nozzle column in the carriage direction of the medium by the certain distance and formed of a nozzle that is in a third chamber and the plurality of second nozzles at every third chamber from the third chamber.

14. The method of claim 8, wherein the polarity of the potential of the expansion pulse is opposite to the polarity of the potential of the contraction pulse.

* * * * *